United States Patent [19]

Mori et al.

[11] Patent Number: 4,856,486

[45] Date of Patent: Aug. 15, 1989

[54] INTERNAL COMBUSTION ENGINE

[75] Inventors: Seiji Mori, Tokyo; Toshinari Sonoda; Yusuke Kinoshita, both of Saitama, all of Japan

[73] Assignee: Honda Giken Kogyo Kabushiki Kaisha, Tokyo, Japan

[21] Appl. No.: 194,389

[22] Filed: May 16, 1988

[30] Foreign Application Priority Data

May 15, 1987 [JP] Japan ..... 62-118380
Oct. 21, 1987 [JP] Japan ..... 62-161248

[51] Int. Cl.[4] ..... F02B 25/06

[52] U.S. Cl. ..... 123/572; 123/192 B; 123/195 H; 384/429

[58] Field of Search ..... 123/192 B, 572, 196 R, 123/195 H; 184/6.5; 384/429; 74/604

[56] References Cited

U.S. PATENT DOCUMENTS

| | | | |
|---|---|---|---|
| 3,710,774 | 1/1973 | Weseloh et al. | 123/192 B |
| 4,000,666 | 1/1977 | Ito et al. | 74/604 |
| 4,028,963 | 6/1977 | Nakamura et al. | 74/604 |
| 4,074,589 | 2/1978 | Nakamura et al. | 74/604 |
| 4,095,579 | 6/1978 | Iwasa et al. | 123/192 B |
| 4,125,036 | 11/1978 | Nakamura et al. | 74/604 |
| 4,497,292 | 2/1985 | Hayashi et al. | 123/195 H |
| 4,501,234 | 2/1985 | Toki et al. | 123/572 |
| 4,502,424 | 3/1985 | Katoh et al. | 123/196 R |
| 4,520,770 | 6/1985 | Ogawa | 384/429 |
| 4,523,553 | 6/1985 | Backlund | 123/192 B |
| 4,644,911 | 2/1987 | Hidaka et al. | 123/195 H |
| 4,651,691 | 3/1987 | Ogawa | 384/429 X |
| 4,690,111 | 9/1987 | Kohno et al. | 123/192 B |
| 4,696,267 | 9/1987 | Kohno et al. | 123/192 B |
| 4,716,638 | 1/1988 | Ampferer | 123/196 CP X |

*Primary Examiner*—Willis R. Wolfe
*Assistant Examiner*—M. Macy
*Attorney, Agent, or Firm*—Lyon & Lyon

[57] ABSTRACT

An internal combustion engine has a crankcase coupled to a lower end of a cylinder block, the crankcase including an upper case integrally formed with the cylinder block and a lower case fixed to the upper case. The upper and lower cases have a plurality of journal support walls projecting from inner wall surfaces thereof. An oil pan is fixed to the lower open end of the lower case. A crankshaft is rotatably sandwiched by the journal support walls. A breather chamber is mounted on one side of the crankcase and defined by recesses on confronting surfaces of the upper and lower cases, the breather chamber having one end communicating with the crank chamber and an opposite end communicating with an air intake system. At least one balancer shaft is rotatably supported in a balancer chamber mounted on one side of the crankcase. The upper and lower cases define substantially semicylindrical recesses therein which jointly constitute bearings in which the crankshaft and the balancer shaft are rotatably supported. At least one of the upper and lower mating surfaces has an oil groove communicating with said recesses for being supplied with lubricating oil. The oil groove and the recesses are formed upon casting of the upper or lower case having the at least one of the upper and lower mating surfaces.

11 Claims, 4 Drawing Sheets

INTERNAL COMBUSTION ENGINE

BACKGROUND OF THE INVENTION

The present invention relates to an internal combustion engine having a stiffened crankcase and a shaft bearing structure with a built-in lubricating oil supply system.

In some conventional internal combustion engines, a bearing cap which supports a lower portion of a journal for supporting a crankshaft against a crankcase is fastened to the crankcase (see Japanese Laid-Open Patent Publication No. 61-104114, for example).

The engine of such a construction should have a complex reinforcing structure to give a required degree of rigidity to the crankcase.

Some recent internal combustion engines have balancer shafts with balancer weights, the balancer shafts being rotatably supported in the cylinder block symmetrically with respect to the crankshaft. The balancer shafts are rotated at a speed which is twice that of rotation of the crankshaft to cancel out the inertial force due to the reciprocating mass of engine components such as pistons to reduce unwanted vibration. Since the balancer shafts are rotated at the higher speed than that of rotation of the crankshaft, the bearings of the cylinder block in which the balancer shafts are rotatably supported should be supplied with a large amount of lubricating oil.

One known bearing structure for such balancer shafts is disclosed in Japanese Patent Publication No. 54-17106. According to the disclosed bearing structure, balancer shafts are supported in a crankcase by seats, and lubricating oil is led to bearings for the balancer shafts through oil holes defined in the crankcase, oil holes defined in the seats, and oil holes defined in the balancer shafts.

The disclosed bearing structure has however been disadvantageous in that the oil holes must be machined in the crankcase, resulting in an increase in the cost of manufacture. The crankcase is generally formed by casting and hence tends to have cavities therein. Therefore, when the oil holes are subsequently machined in the crankcase, they may communicate with such cavities. With the oil holes joined to the cavities, oil leakage tends to occur during operation. The conventional bearing structure has thus been unreliable.

SUMMARY OF THE INVENTION

It is an object of the present invention to provide an internal combustion engine which has a simple and highly rigid crankcase, the crankcase being employed to define a breather chamber for separating oil from a blowby gas which is to be discharged out.

Another object of the present invention is to provide an internal combustion engine having a bearing structure which can be manufactured at a reduced cost and is highly reliable in operation.

According to the present invention, there is provided an internal combustion engine comprising a cylinder block having an array of cylinders defined therein, a crankcase coupled to a lower end of the cylinder block, the crankcase including an upper case integrally formed with the cylinder block and a lower case fixed to the upper case, the upper and lower cases jointly defining a crank chamber therebetween, the upper and lower cases having a plurality of journal support walls projecting from inner wall surfaces thereof, the lower case having an open lower end, an oil pan fixed to the open lower end of the lower case, an air intake system coupled to the cylinders, a crankshaft rotatably sandwiched by the journal support walls, and a breather chamber mounted on one side of the crankcase and defined by recesses on confronting surfaces of the upper and lower cases, the breather chamber having one end communicating with the crank chamber and an opposite end communicating with the air intake system.

According to the present invention, there is also provided an internal combustion engine comprising an engine body having an array of cylinders defined therein, a bearing member fixed to the engine body, the engine body and the bearing member upper and lower mating surfaces, respectively, joined to each other, and a crankshaft rotatably and at least one balancer shaft rotatably supported between the engine body and the bearing member parallel to each other, the engine body and the bearing member defining substantially semicylindrical recesses therein which jointly constitute bearings in which the crankshaft and the balancer shaft are rotatably supported, at least one of the upper and lower mating surfaces having an oil groove communicating with the recesses for being supplied with lubricating oil, the oil groove and the recesses being formed upon casting of the engine body or the bearing member case having the at least one of the upper and lower mating surfaces.

According to the present invention, there is further provided an internal combustion engine comprising a cylinder block having an array of cylinders defined therein, a crankcase coupled to a lower end of the cylinder block, the crankcase including an upper case integrally formed with the cylinder block and a lower case fixed to the upper case, the upper and lower cases having upper and lower mating surfaces, respectively, joined to each other, a crankshaft rotatably supported in the crankcase, and at least one balancer shaft rotatably supported parallel to the crankshaft, the upper and lower cases defining substantially semicylindrical recesses therein which jointly constitute bearings in which the crankshaft and the balancer shaft are rotatably supported, at least one of the upper and lower mating surfaces having an oil groove communicating with the recesses for being supplied with lubricating oil, the oil groove and the recesses being formed upon casting of the upper or lower case having the at least one of the upper and lower mating surfaces.

According to the present invention, there is also provided an internal combustion engine comprising a cylinder block having an array of cylinders defined therein, a crankcase coupled to a lower end of the cylinder block, the crankcase including an upper case integrally formed with the cylinder block and a lower case fixed to the upper case, the upper and lower cases jointly defining a crank chamber therebetween, the upper and lower cases having a plurality of journal support walls projecting from inner wall surfaces thereof, the lower case having an open lower end, a crankshaft rotatably sandwiched by the journal support walls in the crankcase, a balancer chamber mounted on one side of the crankcase separately from the crank chamber and defined by recesses on confronting surfaces of the upper and lower cases, and a balancer shaft rotatably supported in the balancer chamber.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
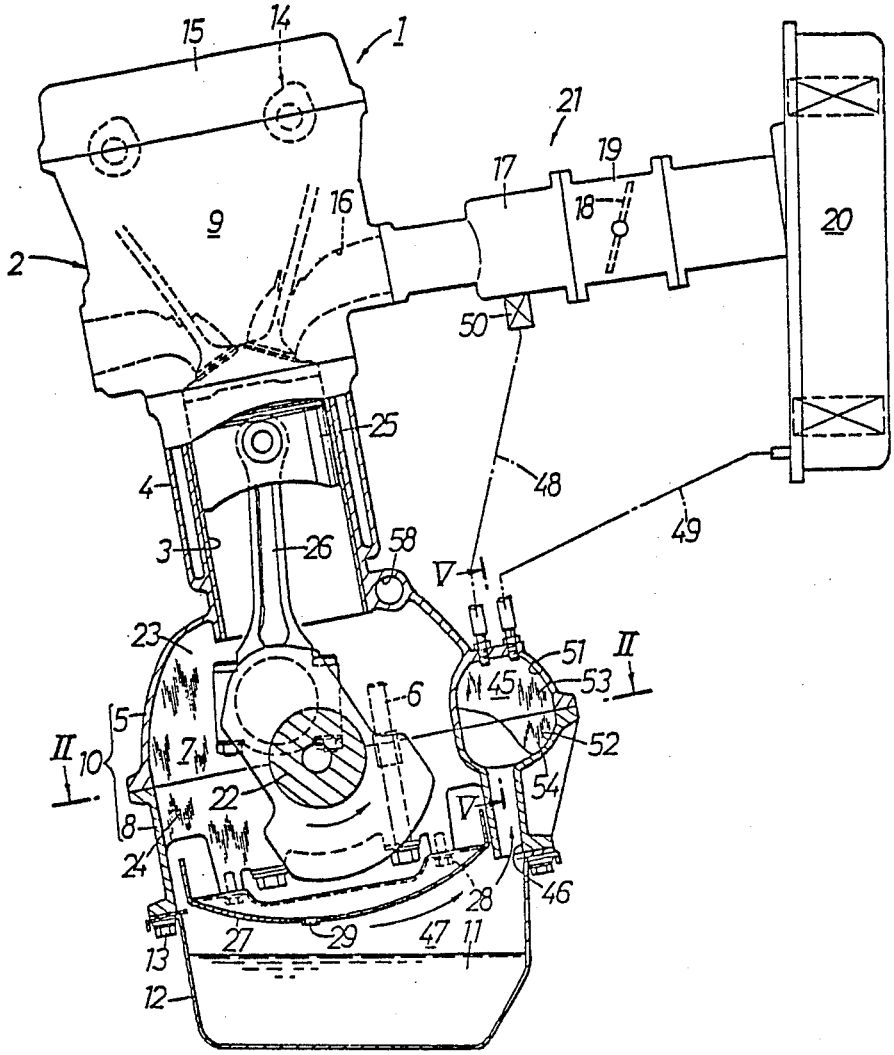
FIG. 1 is a cross-sectional view of an engine according to the present invention, taken along line I—I of FIG. 2.
Figure 2:
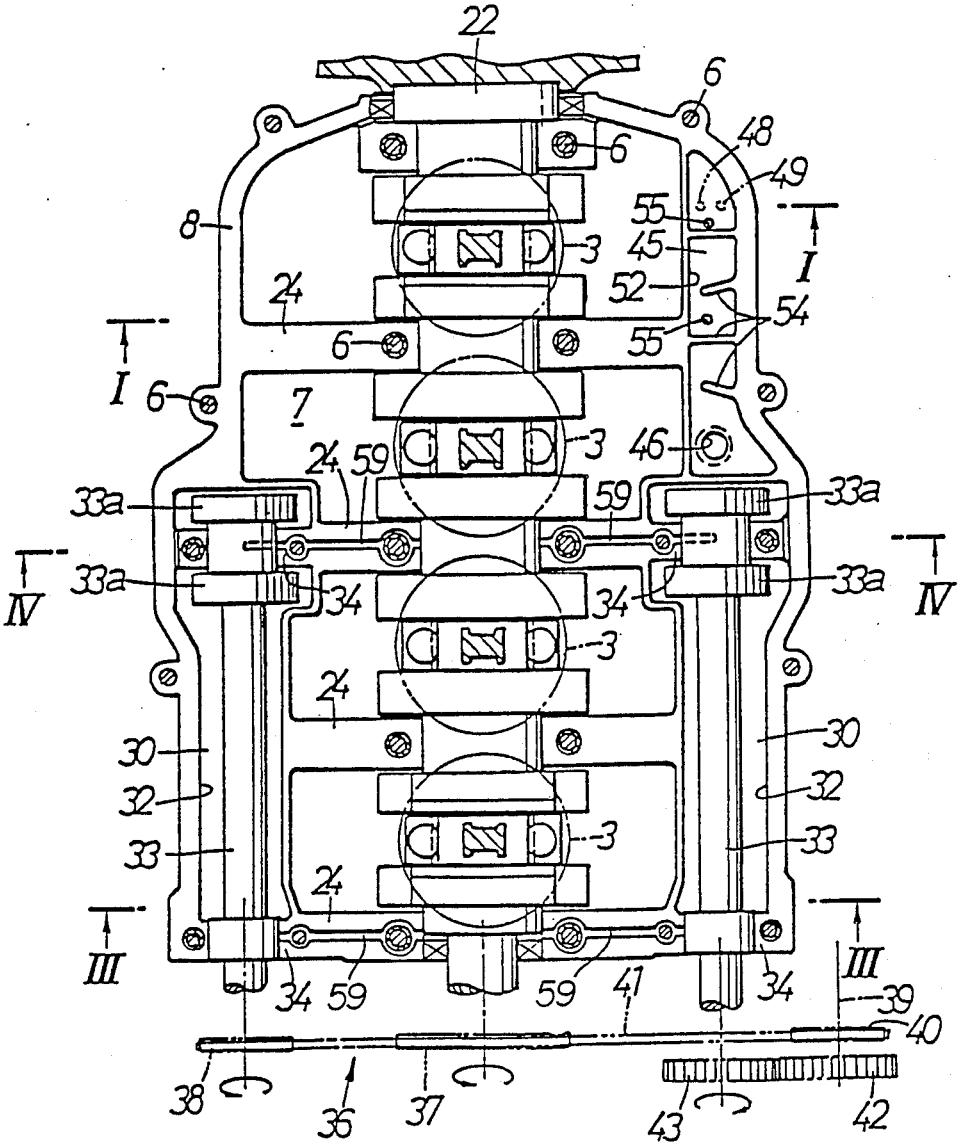
FIG. 2 is a cross-sectional view taken along line II—II of FIG. 1.

As shown in FIGS. 1 and 2, an engine 1 is an inline multicylinder engine having an engine body comprising a cylinder block 4 having an array of cylinders 3, an upper case 5 integrally coupled to the lower end of the cylinder block 4 (the cylinder block 4 and the upper case 5 serve, as an engine body), a lower case (bearing member) 8 fastened to the lower end of the upper case 5 by means of bolts 6 and defining a crank chamber 7 between itself and the upper case 5, and a cylinder head 9 fastened to the upper end of the cylinder block 4 by means of bolts.

The upper case 5 and the lower case 8 jointly constitute a crankcase 10 having an open lower end to which an oil pan 12 for storing lubricating oil 11 is fastened by means of bolts 13.

A head cover 15 is joined to the upper end of the cylinder head 9 by means of bolts in covering relation to a valve operating device 14 disposed in the cylinder head 9. An intake manifold 17 for distributing intake air into intake ports 16 communicating with the respective cylinders 3 is mounted on one side surface of the cylinder head 9. The intake manifold 17 has an inlet coupled to a throttle body or housing 19 which houses a throttle valve 18. The throttle body 19 has an inlet coupled to an air cleaner 20 for supplying cleaned air into the throttle body 19. The intake manifold 17, the throttle body 19, and the air cleaner 20 jointly serve as an air intake system 21 for the engine 1.

A crankshaft 22 housed in the crankcase 10 is rotatably sandwiched between a plurality of upper and lower journal support walls 23, 24 projecting as partitions from the inner wall surfaces of the upper and lower cases 5, 8 and spaced along the crankshaft 22. The crankshaft 22 is operatively coupled to pistons 25 slidably fitted in the respective cylinders 3 by means of connecting rods 26, respectively.

To the lower ends of the journal support walls 24 of the lower case 8, there is connected a baffle plate 27 by means of bolts 28 for isolating the crankshaft 22 from the surface of the lubricating oil in the oil pan 12. The baffle plate 27 serves to prevent the crankshaft 22 from being touched by the surface of the lubricating oil which may be roughened or made turbulent when the engine is caused to vibrate. Therefore, any resistance to rotation of the crankshaft 22, which would otherwise be applied by the lubricating oil, is eliminated.

The baffle plate 27 is curved so as to be convex downwardly along the arcuate path of a maximum-diameter portion of the crankshaft 22. The baffle plate 27 has a small hole 29 defined in its lowest portion. The lubricating oil 11 in the oil pan 12 is supplied to the crankshaft 22 and other engine parts by means of an oil pump (not shown), and then flows onto the baffle plate 27 from which the oil is discharged through the small hole 29 into the oil pan 12. Therefore, no oil remains pooled on the baffle plate 27.

Figure 3:
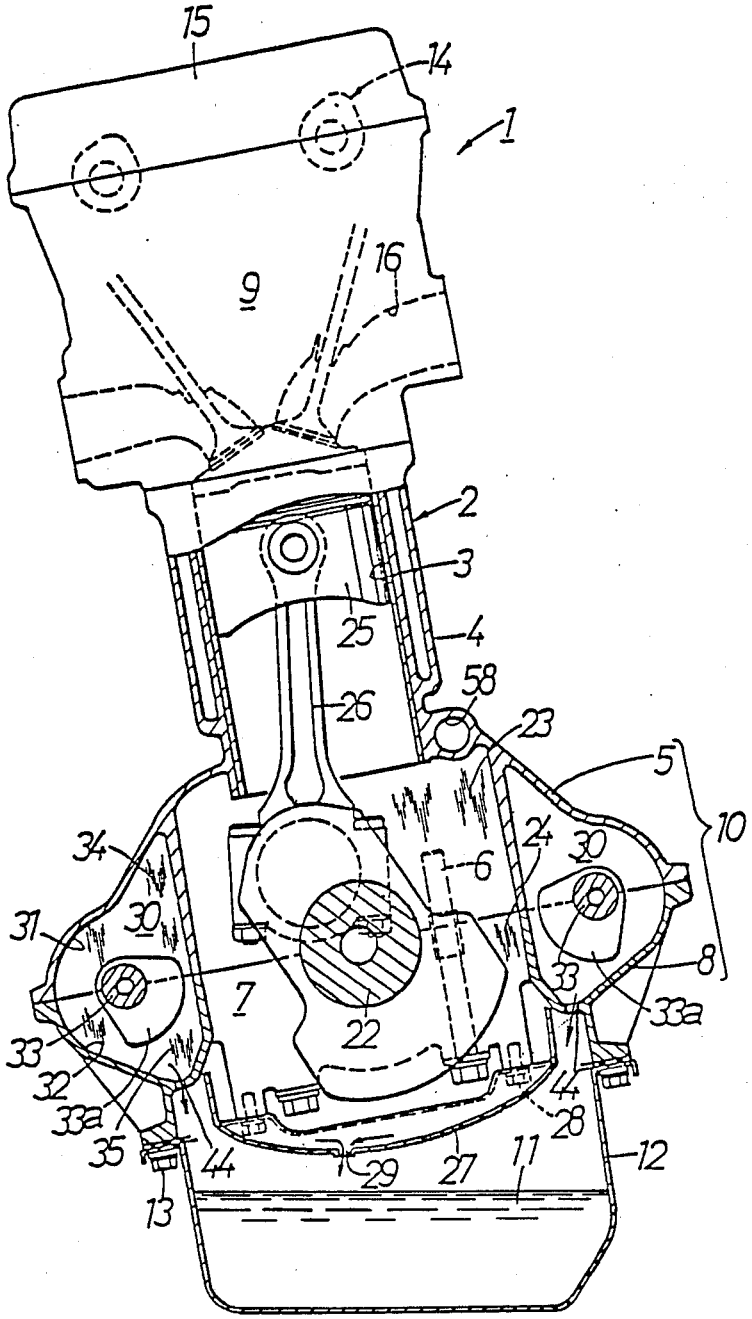
FIG. 3 is a cross-sectional view taken along line III—III of FIG. 2.

As illustrated in FIGS. 2 and 3, the crankcase 10 has a pair of balancer chambers 30 defined in its opposite sides and extending longitudinally therealong. The balancer chambers 30 are in the form of recesses 31, 32 on the confronting surfaces of the upper and lower cases 5, 8. The balancer chambers 30 house therein a pair of balancer shafts 33, respectively, extending parallel to the crankshaft 22 and rotatably supported by bearing walls 34, 35 projecting from inner wall surfaces of the balancer chambers 30.

Each of the balancer shafts 33 has an end projecting out of one end of the balancer chamber 30 and the other end terminating in the balancer chamber 30 at a central portion of the crankcase 22 in its longitudinal direction. The balancer shaft 33 has a pair of axially spaced balancer weights 33*a* disposed on the other end thereof in sandwiching relation to one pair of bearing walls 34, 35.

The projecting ends of the balancer shafts 33 are operatively coupled to the crankshaft 22 by means of a timing transmission device 36.

As shown in FIG. 2, the timing transmission device 36 comprises a toothed driver pulley 37 fixed to the crankshaft 22, a toothed driven pulley 38 fixed to the lefthand (as viewed in FIG. 2) balancer shaft 33, a toothed driven pulley 40 fixed to an intermediate shaft 39 rotatably supported on the crankcase 10 adjacent and parallel to the righthand balancer shaft 33, a timing belt 41 trained around the pulleys 37, 38, 40, a driver gear 42 fixed to the intermediate shaft 39 adjacent to the driven pulley 40, and a driven gear 43 fixed to the righthand balancer shaft 33 and held in mesh with the driver gear 42. The number of teeth of each of the driven pulleys 38, 40 is half that of teeth of the driver pulley 37, and the gears 42, 43 have the same number of teeth. When the crankshaft 22 rotates, the balancer shafts 33 are rotated in mutually opposite directions at a speed which is twice the speed of rotation of the crankshaft 22. The secondary inertial force of the reciprocating mass of components such as the pistons 25 of the engine 1 is cancelled out by combined centrifugal forces of the weights 33*a*.

As shown in FIG. 3, each of the balancer chambers 30 has a small hole 44 defined in a bottom wall thereof to provide communication between the interior space of the balancer chamber 30 and the space in the oil pan 12 outside of the baffle plate 27.

Figure 5:
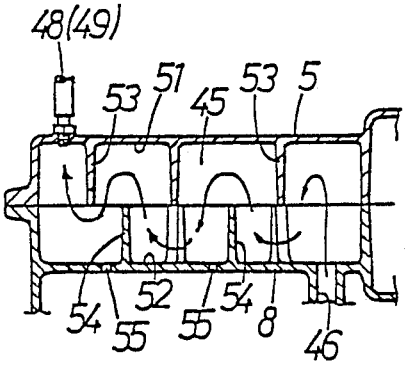
FIG. 5 is a cross-sectional view taken along line V—V of FIG. 1.

As illustrated in FIGS. 1, 2, and 5, a breather chamber 45 is defined in one side of the crankcase 22 adjacent to one (the righthand one in FIG. 2) of the balancer chambers 30 in the longitudinal direction of the crankcase 22. The breather chamber 45 is defined by recesses 51, 52 on the confronting surfaces of the upper and lower cases 5, 8.

The breather chamber 45 is held in communication with a space 47 between the baffle plate 27 and the surface of the oil in the oil pan 12 through an inlet hole 46 defined in the bottom wall of the breather chamber 45 at one end thereof. The breather chamber 45 is also held in communication with upstream portions of the intake manifold 17 and the air cleaner 20 through first and second outlet pipes 48, 49 connected to the breather chamber 45 on its upper wall at the other end thereof. The first outlet pipe 48 has a known pressure regulating valve 50.

The breather chamber 45 has its inner space shaped as a labyrinth by a plurality of staggered walls 53, 54 projecting inwardly from the inner wall surfaces of the recesses 51, 52, the labyrinth extending between the opposite ends of the breather chamber 45. The lower case 8 has a plurality of longitudinally spaced small holes 55 defined therein to provide communication between the labyrinth and the space 47.

Figure 4:
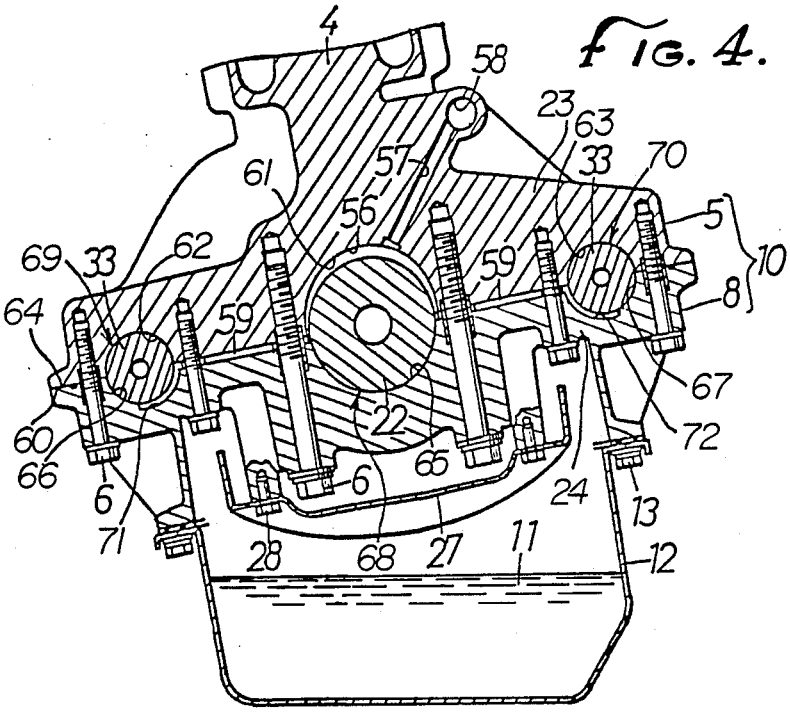
FIG. 4 is a cross-sectional view taken along line IV—IV of FIG. 2.

As shown in FIG. 4, the lubricating oil pumped from the oil pan 12 is fed under pressure to a hollow space in the crankshaft 22 through a main oil passage or gallery 58 defined in the cylinder block 5 and oil passages 57 extending radially inwardly from the main oil passage 58 toward oil grooves 56 defined in the inner peripheral surfaces of the central and outer journal support walls 23. From the oil grooves 56, the lubricating oil is supplied to the journals and crankpins of the crankshaft 22. The lubricating oil in the main oil passage 58 is also supplied to the valve operating device 14 through an oil passage (not shown).

A portion of the oil flowing through the oil passages 56 is supplied to the inner peripheral surfaces of the bearing walls 34, 35 of the balancer chambers 30 through oil grooves 59 defined in the upper mating surfaces of the lower journal support walls 24.

Figure 7:
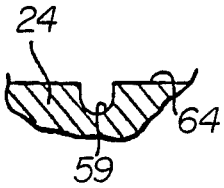
FIG. 7 is a cross-sectional view taken along line VII—VII of FIG. 6.
Figure 6:
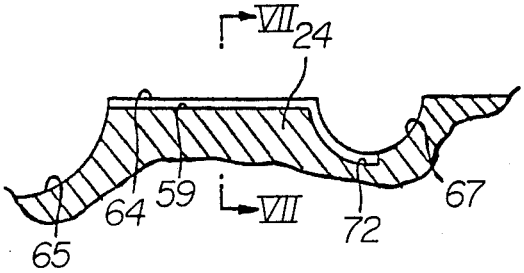
FIG. 6 is an enlarged fragmentary cross-sectional view of a bearing structure in the engine.

More specifically, as shown in FIG. 4, the upper case 5 has a lower mating surface 60 and the lower case 8 has an upper mating surface 64, the lower and upper mating surfaces 60, 64 being held in mating engagement with each other. The upper mating surface 64 has defined therein semicylindrical recesses 61, 62, 63 opening downwardly, the oil grooves 56 being defined by the semicylindrical recesses 61. The upper mating surface 60 has defined therein semicylindrical recesses 65, 66, 67 opening upwardly in registry with the recesses 61, 62, 63, respectively. When the mating surfaces 60, 64 are held against each other, the semicylindrical recesses 61, 62, 63 and the semicircular recesses 65, 66, 67 jointly define substantially cylindrical bearings 68, 69, 70, respectively, in which the crankshaft 22 and the balancer shafts 33 are rotatably supported. As shown in FIGS. 4, 6 and 7, are defined in the upper mating surfaces 64 communicate with arcuate oil grooves 71, 72, respectively, defined in the peripheral surfaces of the recesses 66, 67, respectively. The oil grooves 59 thus have ends communicating with the oil grooves 56 and opposite ends with the oil grooves 71, 72. The oil grooves 59, the recesses 61, 62, 63, 65, 66, 67, and the oil grooves 71, 72 are defined at the same time that the upper and lower cases 5, 8 are cast.

While the engine is in operation, blowby gases produced in the crank chamber 7 flow into the space 47 below the baffle plate 27 and then flow along the lower surface of the baffle plate 27 into the breather chamber 45 through the inlet hole 46. As the blowby gases flow through the labyrinth space in the breather chamber 45, oil is separated from the blowby gases, and the blowby gases are then supplied via the first and second outlet pipes 48, 49 into the air intake system 21 for recombustion in the cylinders 3.

The oil separated from the blowby gases in the breather chamber 45 flows down via the inlet hole 46 and the small holes 55 back into the oil pan 12. No matter how the engine 1 may be tilted at this time, the oil returning from the breather chamber 45 into the oil pan 12 is prevented from touching the crankshaft 22 by the baffle plate 27. Therefore, the oil does not impose any resistance o the rotation of the crankshaft 22.

Lubricating oil having lubricated the balancer shafts 33 returns from the balancer chambers 30 through the small holes 44 into the oil pan 12. This oil is also prevented from touching the crankshaft 22 by the baffle plate 27.

Lubricating oil which has lubricated the crankshaft 22 and been scattered around the crankshaft 22 is prevented by the baffle plate 27 from entering the inlet hole 46 and the small holes 55 of the breather chamber 45.

The journal support walls 23, 24 disposed in the upper and lower cases 5, 8 for supporting the crankshaft 22 greatly contribute to an increased degree of rigidity of the crankcase 10.

Since the breather chamber 45 is composed of the recesses 51, 52 defined by the confronting surfaces of the upper and lower cases 5, 8, no special box or casing would be required to define the breather chamber 45. The crankcase 10 is further stiffened by the peripheral wall of the breather chamber 45 and also the peripheral walls of the balancer chambers 30.

Lubricating oil supplied to the oil grooves 56 lubricates the journals of the crankshaft 22, and is then partly supplied to the oil grooves 59, from which the oil is led into the oil grooves 71, 72 to lubricate the bearings 69, 70 for the balancer shafts 33. Then, the lubricating oil is discharged into the oil pan 12 through discharge passages (not shown). While the engine 1 is not in operation, lubricating oil remains trapped in the oil grooves 59, 71, 72. Therefore, when the engine 1 is subsequently started, the bearings 68, 69, 70 are well lubricated by the trapped lubricating oil even if the supply of lubricating oil from the oil pump is delayed, and hence the engine 1 can smoothly be started.

Since the oil grooves 59, the recesses 61, 62, 63, 65, 66, 67, and the oil grooves 71, 72 are defined at the same time that the upper and lower cases 5, 8 are cast, no subsequent machining is required to define these recesses and oil grooves, and no lubricating oil would leak from the recesses and oil grooves through cavities in the cast upper and lower cases 5, 8. Therefore, the lubricating system is highly reliable in operation.

Although a certain preferred embodiment has been shown and described, it should be understood that many changes and modifications may be made therein without departing from the scope of the appended claims.

What is claimed is:

1. An internal combustion engine comprising:

a cylinder block having an array of cylinders defined therein;

a crankcase coupled to a lower end of said cylinder block, said crankcase including an upper case integrally formed with said cylinder block and a lower case fixed to said upper case, said upper and lower cases jointly defining a crank chamber therebetween, said upper and lower cases having a plurality of journal support walls projecting from inner wall surfaces thereof, said lower case having an open lower end;

an oil pan fixed to said open lower end of the lower case;

an air intake system coupled to said cylinders;

a crankshaft rotatably sandwiched by said journal support walls in said crankcase; and a breather chamber mounted on one side of said crankcase and defined by recesses on confronting surfaces of said upper and lower cases, said breather chamber having one end communicating with said crank chamber and an opposite end communicating with said air intake system.

2. An internal combustion engine according to claim 1, wherein said journal support walls are spaced along said crankshaft.

3. An internal combustion engine according to claim 1, wherein said breather chamber includes a bottom wall having an inlet defined therein at said one end for introducing blowby gases from said crank chamber into said breather chamber and an upper wall having an outlet defined therein at said opposite end for introducing blowby gases from which oil has been separated from said breather chamber into said air intake system.

4. An internal combustion engine according to claim 3, wherein said inlet of said breather chamber opens into said oil pan.

5. An internal combustion engine according to claim 1, further including a baffle plate disposed between said lower case and said oil pan.

6. An internal combustion engine according to claim 5, wherein said baffle plate is convex toward said oil pan and has a hole defined in a lowest portion thereof.

7. An internal combustion engine comprising:

an engine body having an array of cylinders defined therein;

a bearing member fixed to said engine body, said engine body and said bearing member upper and lower mating surfaces, respectively, joined to each other;

a crankshaft rotatably and at least one balancer shaft rotatably supported between said engine body and said bearing member parallel to each other;

said engine body and said bearing member defining substantially semicylindrical recesses therein which jointly constitute bearings in which said crankshaft and said balancer shaft are rotatably supported; and at least one of said upper and lower mating surfaces having an oil groove communicating with said recesses for being supplied with lubricating oil, said oil groove and said recesses being formed upon casting of said engine body or said bearing member case having said at least one of said upper and lower mating surfaces.

8. An internal combustion engine according to claim 7, wherein said oil groove is defined in said lower mating surface, said lower mating surface also having an arcuate oil groove defined in said recess of the bearing in which said shaft is rotatably supported, said arcuate oil groove communicating with said oil groove.

9. An internal combustion engine according to claim 8, wherein said engine body has a main oil gallery communicating with said recess of the bearing in which said crankshaft is rotatably supported, for thereby supplying lubricating oil from said main oil gallery through said recess and said oil groove to said arcuate oil groove.

10. An internal combustion engine comprising:

a cylinder block having an array of cylinders defined therein;

a crankcase coupled to a lower end of said cylinder block, said crankcase including an upper case integrally formed with said cylinder block and a lower case fixed to said upper case, said upper and lower cases having upper and lower mating surfaces, respectively, joined to each other;

a crankshaft rotatably supported in said crankcase;

at least one balancer shaft rotatably supported parallel to said crankshaft;

said upper and lower cases defining substantially semicylindrical recesses therein which jointly constitute bearings in which said crankshaft and said balancer shaft are rotatably supported; and at least one of said upper and lower mating surfaces having an oil groove communicating with said recesses for being supplied with lubricating oil, said oil groove and said recesses being formed upon casting of said upper or lower case having said at least one of said upper and lower mating surfaces.

11. An internal combustion engine comprising:

a cylinder block having an array of cylinders defined therein;

a crankcase coupled to a lower end of said cylinder block, said crankcase including an upper case integrally formed with said cylinder block and a lower case fixed to said upper case, said upper and lower cases jointly defining a crank chamber therebetween, said upper and lower cases having a plurality of journal support walls projecting from inner wall surfaces thereof, said lower case having an open lower end;

a crankshaft rotatably sandwiched by said journal support walls in said crankcase;

a balancer chamber mounted on one side of said crankcase separately from said crank chamber and defined by recesses on confronting surfaces of said upper and lower cases; and a balancer shaft rotatably supported in said balancer chamber.

* * * * *